US006645165B2

(12) United States Patent
Waldridge et al.

(10) Patent No.: US 6,645,165 B2
(45) Date of Patent: Nov. 11, 2003

(54) LYMPHEDEMA TREATMENT SYSTEM

(75) Inventors: Irene A. Waldridge, Shakopee, MN (US); Eric L. McKee, East Bethel, MN (US)

(73) Assignee: Tactile Systems Technology, Inc., Shakopee, MN (US)

( * ) Notice: Subject to any disclaimer, the term of this patent is extended or adjusted under 35 U.S.C. 154(b) by 221 days.

(21) Appl. No.: 09/730,081

(22) Filed: Dec. 5, 2000

(65) Prior Publication Data

US 2001/0018563 A1 Aug. 30, 2001

Related U.S. Application Data

(63) Continuation-in-part of application No. 08/843,023, filed on Apr. 11, 1997, now Pat. No. 6,179,796.

(51) Int. Cl.[7] ..... A61H 23/04
(52) U.S. Cl. ..... 601/152
(58) Field of Search ..... 601/41, 44, 148–152

(56) References Cited

U.S. PATENT DOCUMENTS

| | | | | |
|---|---|---|---|---|
| 1,147,560 A | | 7/1915 | Shurtleff | |
| 1,608,239 A | | 11/1926 | Rosett | |
| 2,345,073 A | | 3/1944 | Rosett | 251/104 |
| 2,361,242 A | | 10/1944 | Rosett | 128/299 |
| 3,880,149 A | | 4/1975 | Kawaguchi | 128/24 |
| 4,057,046 A | | 11/1977 | Kawaguchi | 128/24 |
| 4,552,132 A | | 11/1985 | Ruscigno | 128/38 |
| 4,573,453 A | | 3/1986 | Tissot | 128/64 |
| 4,753,226 A | | 6/1988 | Zheng et al. | 128/64 |
| 4,762,121 A | | 8/1988 | Shienfeld | 128/64 |
| 4,865,020 A | * | 9/1989 | Bullard | 601/152 |
| 5,014,681 A | | 5/1991 | Neeman et al. | 128/64 |
| 5,031,604 A | | 7/1991 | Dye | 128/64 |
| 5,052,377 A | | 10/1991 | Frajdenrajch | 128/64 |
| 5,437,610 A | | 8/1995 | Cariapa et al. | 601/152 |
| 5,453,081 A | | 9/1995 | Hansen | 601/150 |
| 5,496,262 A | | 3/1996 | Johnson, Jr. et al. | 601/152 |
| 5,626,556 A | | 5/1997 | Tobler et al. | 601/151 |

FOREIGN PATENT DOCUMENTS

| | | | |
|---|---|---|---|
| SU | 1452523 A1 | 1/1989 | 601/152 |

* cited by examiner

*Primary Examiner*—Danton D. DeMille
(74) *Attorney, Agent, or Firm*—Nawrocki, Rooney & Sivertson, P.A.

(57) ABSTRACT

A method of body manipulation in furtherance of treating lymphedema is provided. A wrap, adapted to fit about a body extremity and having a trunk region, and limb regions, and a plurality of compartments distributed throughout the regions, is provided and applied to the body extremity. Each of the compartments of the plurality of compartments are capable of selective pressurization and depressurization. The body extremity is prepared for receipt of lymph fluid via a first pressurization and depressurization sequence of select compartments within select regions of the regions of the wrap, and lymph fluid is drained from the body extremity via a second pressurization and depressurization sequence of select compartments within select regions of the regions of the wrap, whereby the lymphatic system is stimulated so as to promote readsorption of pooled lymph fluid within surrounding tissue.

4 Claims, 5 Drawing Sheets

LYMPHEDEMA TREATMENT SYSTEM

CROSS-REFERENCE TO RELATED APPLICATIONS

This application is a continuation-in-part of application Ser. No. 08/843,023 filed on Apr. 11, 1997 now U.S. Pat. No. 6,179,796.

BACKGROUND OF THE INVENTION

1. Field of the Invention

This invention relates to apparatus and method for the treatment of lymphedema. More particularly it relates to a wrap having a series of bladders applied to the trunk of the body, wherein the bladders are compressed and decompressed on an individual basis to stimulate the lymphatic system.

2. Description of the Prior Art

The lymphatic system consists of lymph vessels, lymph nodes and lymphoid tissues and is a secondary system within the circulatory system that removes waste. Unlike the closed-loop blood circulatory system, the lymphatic system works according to a one-way principal. That is, the lymphatic system is a drainage system to drain away lymph which continually escapes from the blood in small amounts. The lymph is first collected at the lymph capillaries, which in turn drain into larger vessels. The lymph is pumped in and out of these vessels by movements of adjacent muscles and by contractions of the walls of the larger vessels, and moves through the lymphatic system in one direction. Foreign matter and bacteria are filtered at various lymph node groups after which the fluid empties into the venous portion of the blood system, mainly through the thoracic duct. A healthy person will drain one to two liters of lymph fluid through this duct every 24 hours. Without proper drainage into the duct, lymphedema results.

Lymphedema is an accumulation of a watery fluid in the body causing a swelling or edema of the affected area. The swelling causes pain, discomfort, disfigurement and interference with wound healing and, if left untreated, can cause fibrosis. Fibrosis is a hardening of the tissue in the affected area which may further complicate the drainage process and can cause life-threatening conditions, such as infections. Lymphedema may result from surgery when the lymph nodes are removed in order to prevent the further spread of cancerous conditions, such as with a mastectomy or prostectomy, and may also be caused by filariasis. Lymphedema may be primary or congenital.

In recent years, several common therapies for lymphedema have been proposed. Special bandages, such as a limb compression sleeve or stocking, have been utilized to help prevent accumulation of fluid in a limb by holding the tissue tightly. This treatment is incomplete, however, because it treats the limb only and does nothing to actually move the fluid. This treatment is also uncomfortable (and may be painful) and is not easily adaptable to the trunk of the body. In application to the limb, this treatment may interfere with mobility.

Pneumatic compression devices have also been used to assist limb lymph drainage by increasing the tissue pressure, thus, forcing fluid along the lymphatic system. This treatment approach, however, is incomplete because it treats the limb only. This treatment approach may cause fibrosis or accumulation of fluids in non-affected areas. The high pressure required to force the fluid along the system is uncomfortable or painful, while lower pressure devices result in an increase in therapeutic time.

Another approach is manual lymph drainage (MLD), a gentle manual treatment technique which improves lymphatic system functioning through a highly specific massage, which provides mild mechanical stimuli to the lymphatic system. MLD has the advantage of being able to treat the entire lymphatic system, including the arms, legs and trunk of the body. The MLD treatment technique applies just enough pressure to massage pooled fluids from larger areas toward specific lymph nodes within the body by mechanically stimulating the lymphatic system to cause contraction of the lymph collectors sufficient to help move the pooled fluids by promoting reabsorption of the pooled fluids within the surrounding tissues. Too much applied pressure will cause the lymph collectors to go into spasm. This technique is effective but also expensive, however, as a person trained in the MLD technique is required to perform the massage therapy.

U.S. Pat. No. 5,453,081, issued to Hansen, suggests an apparatus for generating air pressure pulses which are delivered to a vest or mattress accommodating a person. A diaphragm located within a housing is connected to a wave generator and amplifier operable to vibrate the diaphragm. The vibrating diaphragm produces air pressure pulses, which are delivered to the air accommodating receiver, and which subject the person to repetitive force pulses. The housing has an enclosed chamber accommodating the diaphragm, which divides the chamber into two separate portions, wherein air under pressure may be supplied with a pump to the chamber to pressurize the apparatus, as well as the receiver. A coil connected to the diaphragm is operable to vibrate the diaphragm to pulsate air in the chamber.

U.S. Pat. No. 5,437,610, issued to Cariapa et al., suggests a portable hydraulic extremity pump apparatus for the treatment of edema. This apparatus consists of a flexible compression unit that wraps around an individuals extremity. The unit includes a plurality of prefilled bladders, each containing a separate compression bladder which are connected to a hydraulic pump through valves. The valves, pump, and pressure sensors, which connect to the prefilled bladders, all connect to a programmable control processor to operate the valves and to pump and monitor the bladder pressures. The occurrence of edema is detected by monitoring an increase in pressure in the prefilled bladders. Once edema is detected, the control processor activates the pump and opens valves connected to the compression bladder in a sequential manner to create a sequential pressurization and wave of compression moving proximally on the extremity.

U.S. Pat. No. 5,052,377, issued to Frajdenrajch, suggests an apparatus for massaging parts of the body by sequential cyclic pressure having a massaging boot comprising a plurality of juxtaposed inflatable cells. An inflating conduit is connected to each cell through a series of distributors for receiving a control fluid. Each distributor has a movable membrane arranged to permit passage of the inflating fluid in a downstream direction when the local inflating pressure reaches a value which is a function of the pressure of the control fluid. The cells are inflated in series, one after another, and then deflated in a cyclic manner.

U.S. Pat. No. 5,014,681, issued to Neeman et al., suggests a method and apparatus for treating a body part by applying intermittent compression through an inflatable sleeve applied to and enclosing the body part. The inflatable sleeve is divided into successively overlapping inflatable cells. Pressurized fluids are applied cyclically to successive groups of cells to successively inflate each group, while at the same time deflating a preceding group. As successive groups of cells are inflated (while the remaining cells are deflated), a compression wave is introduced in the sleeve which subjects successive portions of the body part to compression.

U.S. Pat. No. 4,573,453, issued to Tissot, suggests a pneumatic massage apparatus which includes an inflatable sleeve having an inner and outer sheath with lateral partition walls extending between the inner and outer sheaths. The inner and outer sheaths are formed of air-impermeable, non-elastic material and the lateral partition walls are formed of a flexible air-impermeable, non-elastic material. The partition walls and inner and outer sheaths define separate inflatable chambers, adjacent chambers being separated by a partition wall. When a first chamber has been inflated, its feed conduit is closed and the following chambers are inflated in turn to the same feed pressure. The result causes a deformation of the walls of the first chamber, and a slight increase in the internal pressure in this first chamber. Step by step, with the same feed pressure, the appearance of a pressure gradient is created.

U.S. Pat. No. 2,361,242, issued to Rosett, suggests a pneumatic suit or garment adapted to be applied to limbs of a patient, wherein the pneumatic suit has a series of laterally disposed pockets, each of which is provided with a fluid-type flexible bag. The bags are inflated one after another in groups, so as to cause the exertion of waves of pressure from the extremities of the limbs and from the lower portion of the torso of the patient towards the region of the heart. After each bag is inflated, it is immediately subjected to a source of subatmospheric pressure to accelerate the removal of air therefrom and to accentuate the effect. Rosett suggests the pneumatic suit or garment being applied to areas including the arms and legs and lower trunk.

SUMMARY OF THE INVENTION

The present invention provides an apparatus for mechanical stimulation of the lymphatic system for the treatment of lymphedema. A lymphedema treatment system in accordance with the present invention includes a wrap having a plurality of elongate and flexible bladders applied to the trunk of the body. The bladders are compressed and decompressed on an individual basis to stimulate the lymphatic system to provide for drainage of pooled fluids by massaging the pooled fluids within the trunk section of the body towards lymph nodes in the arms, neck or groin of the body. Compression and decompression of the bladders may be provided by a pump.

In a preferred embodiment of the present invention, the apparatus for the treatment of lymphedema may comprise a plurality of elongate and flexible bladders, wherein the plurality of bladders has an orientation adopted to engage the trunk of the body and move pooled fluids within the lymphatic system towards a particular region of the body or away from a particular region of the body. The particular regions of the body may be specific lymph node groups which include the axillary node group, the pelvic node group or the groin node group as well as the thoracic duct. The orientation of the plurality of bladders relative to the particular region may be arcuate so that the plurality of bladders being coextensive and sequentially arranged in a fixed relation may engage the trunk of the body to radially move the pooled fluids within the lymphatic system to the particular region of the body.

In a preferred embodiment, each particular one of the plurality of bladders may be sequentially pressurized and depressurized in a sequence to provide mechanical stimulation of the lymphatic system similar to Manual Lymph Drainage (MLD) massage. In the preferred embodiment, a pumping system is in fluid communication with each particular one of the plurality of bladders and is programmable to sequentially pressurize and depressurize each particular one of the plurality of bladders. The pumping system may be comprised of a pneumatic pump and a plurality of pneumatic hoses to couple the pneumatic pump to each particular one of the plurality of bladders. Each particular one of the plurality of bladders may be pressurized to engage the trunk of the body at a therapeutic pressure. The lymphatic system is mechanically stimulated when each particular one of the plurality of bladders being both pressurized to the therapeutic pressure and depressurized causes contraction of lymph collectors sufficient to move pooled fluids by promoting reabsorption of the pooled fluids within the surrounding tissues without causing the lymph collectors to go into spasm. In the preferred embodiment there may be a predetermined waiting period between a first particular one of the plurality of bladders being fully pressurized and fully depressurized. In addition, depressurization of the first particular one of the plurality of bladders may begin before pressurization of a second particular one of the plurality of bladders begins.

The preferred embodiment may further comprise a wrap sized to wrap around a portion of the trunk of the body to receive and hold each one of the plurality of bladders within a corresponding one of a plurality of compartments. The plurality of bladders are held in an orientation to engage the trunk of the body and move pooled fluids within the lymphatic system either towards or away from specific lymph node groups which include the axillary node group, the pelvic node group or the groin node group. The orientation may be arcuate relative to the particular lymph node group. The wrap may maintain the plurality of bladders in a coextensive relationship such that each particular one of the plurality of bladders is adjacent to one or two other ones of the plurality of bladders. The wrap may be constructed of a stretchable material to accommodate expansion and contraction of the bladders as the bladders are sequentially pressurized and depressurized. The wrap may also limit the maximum diameter under pressurization of each one of the plurality of bladders within the plurality of compartments.

The present invention further provides a method of body manipulation in furtherance of treating lymphedema. The method includes providing a wrap adapted to fit about a body extremity and applying same about the body extremity, more particularly, providing and applying a wrap having a trunk region and limb regions, and a plurality of compartments distributed throughout the regions. Each of the compartments of the plurality of compartments of the wrap regions is capable of selective pressurization and depressurization, as by use of a controllable pneumatic system, or the like, known to those of skill in the art. The method further includes preparing the body extremity for receipt of lymph fluid via a first pressurization and depressurization sequence of select compartments within select regions of the regions of the wrap, and draining lymph fluid from the body extremity via a second pressurization and depressurization sequence of select compartments within select regions of the regions of said wrap. By this method, the lymphatic system is stimulated so as to promote readsorption of pooled lymph fluid within surrounding tissue.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENTS

Figure 1:
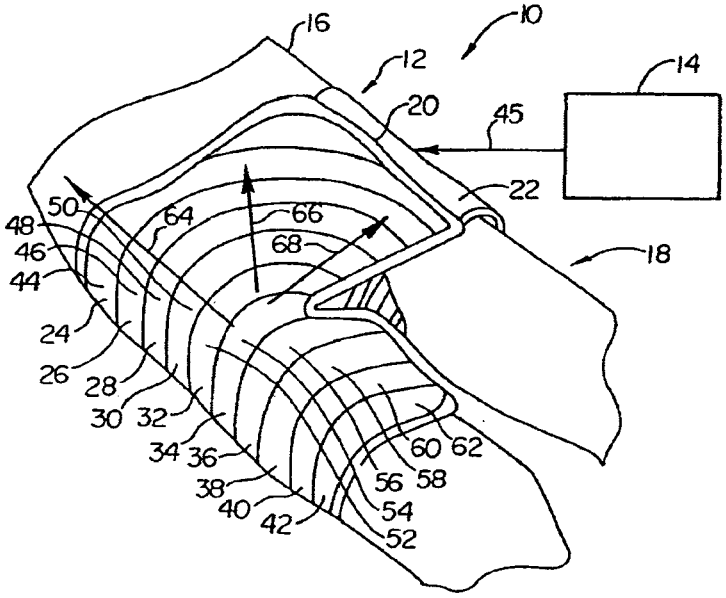
FIG. 1 is a perspective view of the preferred embodiment of a "Lymphedema Treatment System" in accordance with the present invention.

Referring now to the drawings, wherein like reference numerals refer to like elements throughout the several views, FIG. 1 is a perspective view of a preferred embodiment of a lymphedema treatment system in accordance with the present invention. The lymphedema treatment system is shown generally at 10 and consists of a wrap 12 and a pneumatic pump 14. Wrap 12 is shown applied to lower trunk 16 of human body 18. Wrap 12 is positioned on lower trunk 16 by placement on human body 18 when in an open position, then pulling first end 20 over second end 22 until wrap 12 is firmly and completely engaging lower trunk 16. Wrap 12 is then secured by attaching first end 20 to second end 22 through fasteners well known in the art, such as Velcro (not shown). Wrap 12 is comprised of compartments 24, 26, 28, 30, 32, 34, 36, 38, 40 and 42. Each one of compartments 24, 26, 28, 30, 32, 34, 36, 38, 40 and 42 is sized to receive and hold a particular one of a plurality of elongate and flexible bladders 44, 46, 48, 50, 52, 54, 56, 58, 60 and 62, respectively. In the preferred embodiment, compartments 36, 38, 40 and 42 and bladders 56, 58, 60 and 62 are not required, but are shown here to illustrate that many configurations of wrap 12 are within the scope of the present invention. Each of bladders 44, 46, 48, 50, 52, 54, 56, 58, 60 and 62 are in fluid communication with pneumatic pump 14 via pneumatic hoses 45 where pneumatic pump 14 is both portable and programmable and may be programmed to individually and sequentially pressurize and depressurize each particular one of the plurality of bladders in a desired sequence (see also, FIG. 4). Pneumatic hoses 45 comprise a plurality of hoses wherein each hose couples one of the bladders to pneumatic pump 14. The desired sequence provides individual sequential pressurization and depressurization of each one of bladders 44, 46, 48, 50, 52, 54, 56, 58, 60 and 62 to provide mechanical stimulation of the lymphatic system similar to manual lymph drainage massage. Pneumatic pump 14 pressurizes each one of bladders 44, 46, 48, 50, 52, 54, 56, 58, 60 and 62 to a maximum inflation pressure of 5 PSI (approximately 260 mm Hg) where at the maximum inflation pressure each bladder is elastic and has a diameter from 0.5 inches to 2 inches. In the preferred embodiment, wrap 12 is constructed of a stretchable material to accommodate expansion and contraction of each one of bladders 44, 46, 48, 50, 52, 54, 56, 58, 60 and 62 and limits the maximum diameter of each bladder.

In the preferred embodiment, bladders 44, 46, 48, 50, 52, and 54 are held within compartments 24, 26, 28, 30, 32, and 34 of wrap 12 so that the bladders have a generally arcuate shape and are sequentially pressurized and depressurized to engage lower trunk 16 of human body 18 to radially move pooled fluids. The pooled fluids are moved within the lymphatic system of human body 18 either in the direction shown by arrows 64, 66 and 68, or in a direction opposite to the direction shown by arrows 64, 66 and 68. The bladders are oriented to be arcuate relative to three lymph node groups such that radial lines extending from each bladder converge (or diverge) towards each one of the lymph node groups (see also, FIG. 2). Bladders 44, 46, 48, 50, 52, and 54, each being sequentially pressurized and depressurized, engage lower trunk 16 of human body 18 at a therapeutic pressure to provide mechanical stimulation of the lymphatic system. This mechanical stimulation provides for drainage of pooled fluids within the lymphatic system by applying the therapeutic pressure to lower trunk 16 of human body 18 sequentially to move the pooled fluids either towards or away from the selected lymph node groups within the arms, neck or groin of the body by promoting reabsorption in the surrounding tissues. If the applied pressure is too high, the lymph collectors may go into spasm. In the preferred embodiment, the therapeutic pressure measured between the bladders and the body is between 20 mm Hg and 45 mm Hg.

In the preferred embodiment, there is a predetermined waiting period of one to three seconds between pressurization and depressurization of each bladder. Thus, each of bladders 44, 46, 48, 50, 52, and 54 are pressurized for one to three seconds to provide the mechanical stimulation to the lymphatic system. Each bladder is depressurized before pressurization of the next bladder begins. In FIG. 1, for example, bladder 44 would be depressurized before bladder 46 is pressurized. Each of bladders 44, 46, 48, 50, 52, and 54 are pressurized to apply the therapeutic pressure over a time period which is a predetermined minimum pressurization time period, and are depressurized over a time period which is a predetermined minimum depressurization time period. It is understood that the embodiment shown in FIG. 1 is just one of many possible configurations of a lymphedema treatment system in accordance with the present invention.

Figure 2:
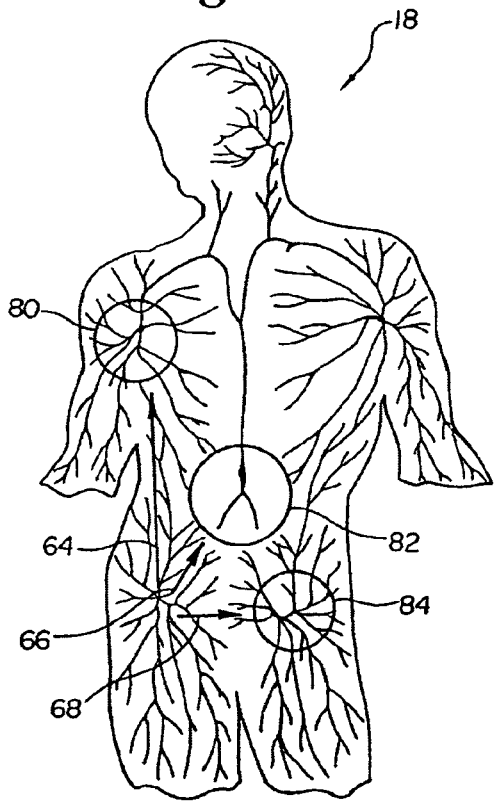
FIG. 2 is a perspective view of the human body showing specific lymph node groups and the thoracic duct.

FIG. 2 is a perspective view of the human body showing the location of specific lymph node groups. The lymph node groups shown in FIG. 2 do not comprise all the lymph node groups within human body 18, but are representative and described for illustrative purposes. FIG. 2 shows axillary node group 80, pelvic node group 82 including a portion of the thoracic duct, and groin node group 84 and diverging arrows 64, 66 and 68. An application of wrap 12 as shown in FIG. 1 provides for drainage of pooled fluids by massaging the pooled fluids in the direction shown by arrow 64 towards axillary node group 80, in the direction shown by arrow 66 towards pelvic node group 82, and in the direction shown by arrow 68 towards groin node group 84. In the human body, the lymph capillaries reabsorb tissue fluid and drain through precollectors to the lymph angions. The lymph angions contract in sequence to help move the fluid along the lymphatic system. The application of the wrap, as shown in FIG. 1, stimulates this natural drainage through sequentially pressurizing and depressurizing each particular one of bladders 44, 46, 48, 50, 52, and 54 to stimulate the initial lymph capillaries and provide for contraction of the lymph angions. Pooled fluids may be moved to axillary node group 80, pelvic node group 82, or groin node group 84, where foreign matter and bacteria are filtered out and the fluid is emptied into the vein portion of the human body blood system.

Figure 3:
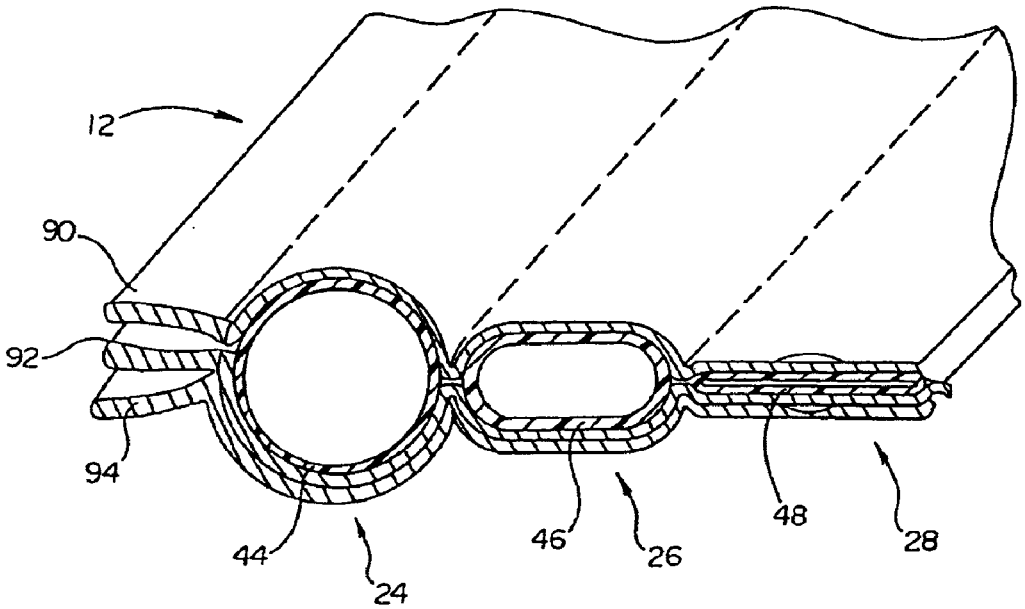
FIG. 3 is a detailed cross-section view of the embodiment of FIG. 1 showing various levels of bladder pressurization.

FIG. 3 is a detailed cross-sectional view of a preferred embodiment in accordance with the present invention showing the construction of wrap 12 and various levels of bladder pressurization. FIG. 3 shows a portion of wrap 12 comprising bladders 44, 46 and 48. Bladders 44, 46 and 48 may each be constructed of an elastic material to provide stretchability when going from a depressurized state to a fully pressurized state. Bladder 44 is shown in a fully pressurized state, bladder 46 is shown in a partially pressurized state, and bladder 48 is shown in a depressurized state.

Compartments 24, 26 and 28 are constructed of a combination of materials. A first layer 90 overlays each of bladders 44, 46 and 48 and is the side of wrap 12 that is in a contact relationship with lower trunk 16 of human body 18. First layer 90 is preferable constructed of a stretchable material and stretches when any of bladders 44, 46 or 48 are fully pressurized to provide the therapeutic pressure to lower trunk 16. The therapeutic pressure is between 20 mm Hg and 45 mm Hg (0.387 and 0.87 psi). Second layer 92 overlays each of bladders 44, 46 and 48 on the side of wrap 12 opposite first layer 90. Second layer 92 is preferably constructed of a durable cotton material. Third layer 94 overlies second layer 92 and provides an outer cover for wrap 12. Third layer 94 is preferably constructed of a cotton material.

Figure 4:
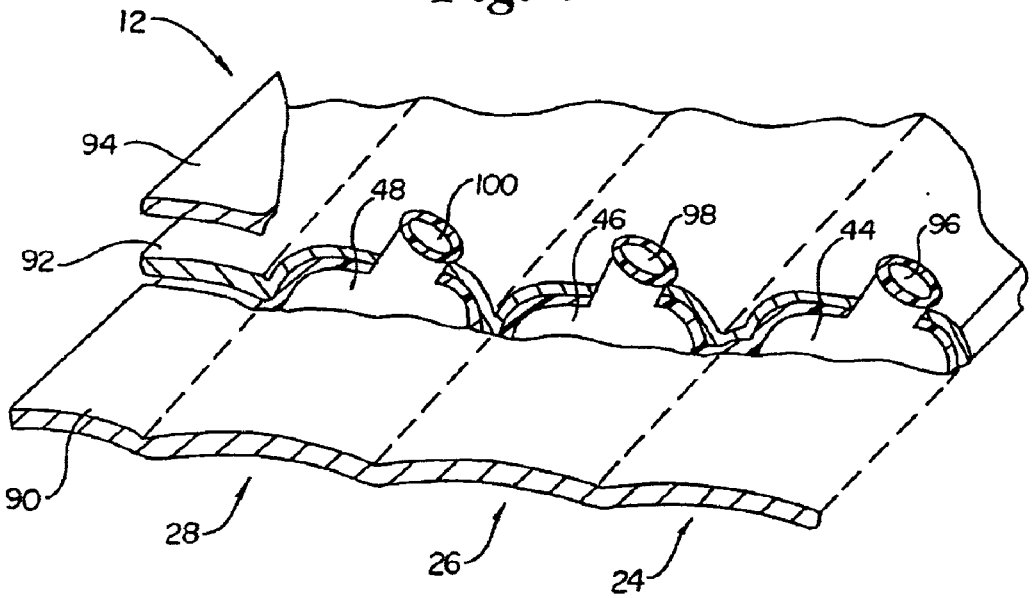
FIG. 4 is a detailed cross-section view of the embodiment of FIG. 1 showing the means to provide bladder pressurization.

FIG. 4 is a detailed cross-section view showing the means to provide bladder pressurization. Pneumatic pump 14 is coupled to and is in fluid communication with each of bladders 44, 46 and 48 via couplings 96, 98 and 100, respectively. Couplings 96, 98 and 100 couple to pneumatic hoses 45 allowing pneumatic air pressurization to be applied individually and sequentially to bladders 44, 46, and 48 to pressurize and depressurize each bladder. In FIG. 4, pneumatic hoses 45 comprise at least three hoses wherein each hose couples one of couplings 96, 98 or 100 to pneumatic pump 14.

Figure 5:
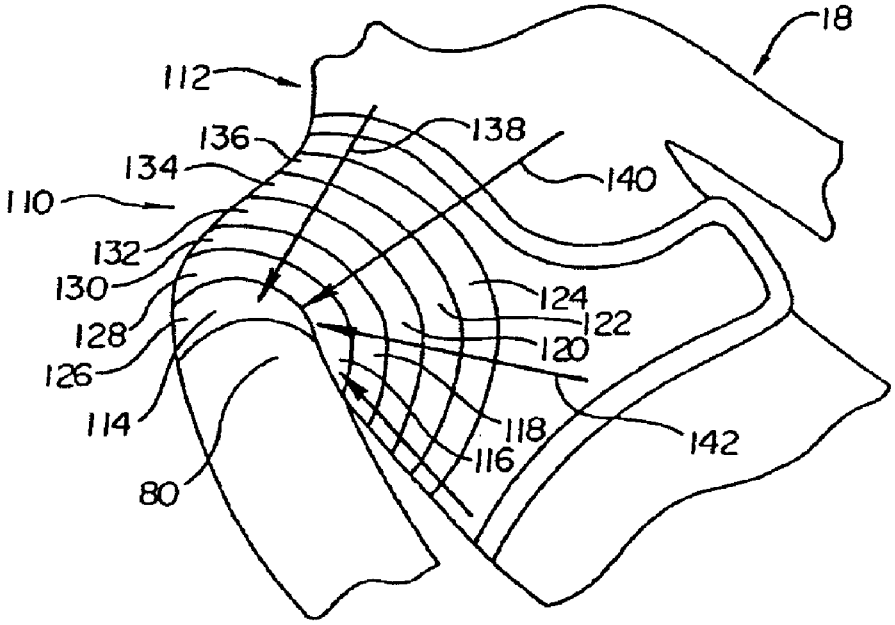
FIG. 5 is a perspective view showing an alternate embodiment in accordance with the present invention.

FIG. 5 is a perspective view showing another embodiment of the present invention. Wrap 110 is shown being applied to an upper trunk 112 of human body 18. Wrap 110 has compartments 114, 116, 118, 120, 122 and 124 containing bladders 126, 128, 130, 132, 134 and 136, respectively. Pneumatic pump 14 is not shown. Bladders 126, 128, 130, 132, 134 and 136 may be sequentially pressurized and depressurized to provide movement of pooled fluids within the lymphatic system towards axillary node group 80 in the direction shown by arrows 138, 140, and 142.

Bladders 126, 128, 130, 132, 134 and 136 when pressurized and depressurized provide a gentle massaging action which provides a mechanical stimulation similar to manual lymph drainage massage to the lymphatic system so that proper drainage may occur. The stimulus is provided by sequential inflation of each bladder. The therapeutic pressure is measured between bladders 126, 128, 130, 132, 134 and 136 and upper trunk 112 and is between 20 mm Hg and 45 mm Hg (0.387 and 0.87 psi) in order to promote reabsorption from the surrounding tissues. Too much pressure against upper trunk 112 will cause the lymph collectors to go into spasm and reduce effectiveness. The plurality of bladders may be individually and sequentially pressurized and depressurized in the direction shown by radial arrows 138, 140, and 142 (converging toward axillary node group 80) to promote drainage of fluids in a direction towards axillary group 80. In terms of the present invention, the bladders 126, 128, 130, 132, 134 and 136 are "oriented" (configured and sequentially pressurized and depressurized) to direct drainage in a direction towards axillary group 80. The bladder configuration is generally arcuate, while the "radial" arrows 138, 140 and 142 point in a direction generally perpendicular to a tangent of the arcuate bladder.

Figure 6:
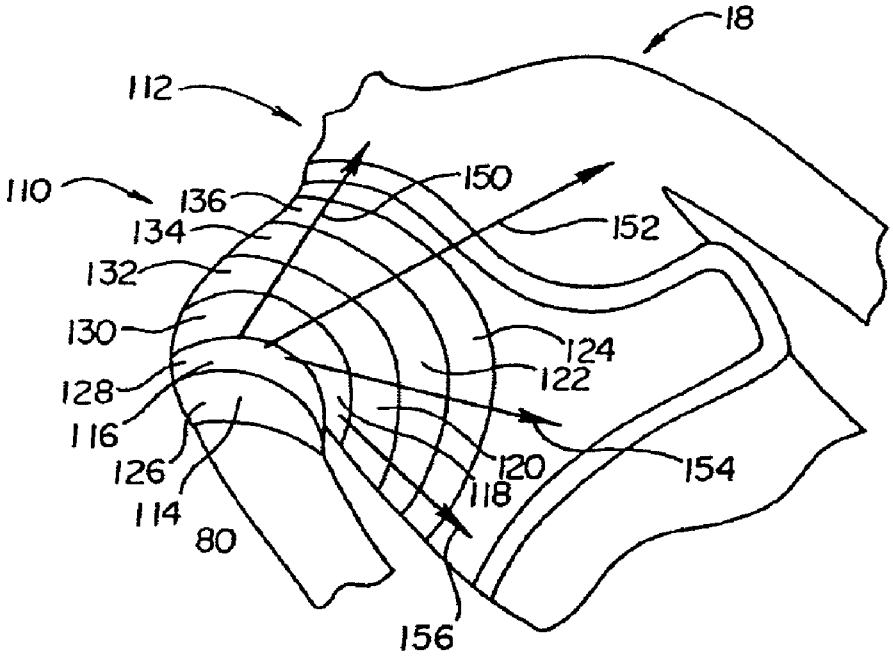
FIG. 6 is a perspective view showing a further alternate embodiment in accordance with the present invention.

FIG. 6 is a perspective view showing a further embodiment in accordance with the present invention. FIG. 5 shows wrap 110 applied to upper trunk 112 of human body 18. Wrap 110 may undergo sequential pressurization and depressurization of bladders 126, 128, 130, 132, 134 and 136 to move pooled fluids away from axillary node group 80 towards other node groups, such as pelvic node group 82 and groin node group 84 (see FIG. 2).

The figures illustrate that alternative constructions in accordance with the present invention may move pooled fluids within human body 18 from several regions to a particular node group, or from a particular region to several node groups, for instance, with reference to FIG. 6, pooled fluids may be moved within the lymphatic system in a direction generally away from axillary node group 80 in the direction shown by arrows 150, 152, 154, and 156 through the configuration of, and through sequential pressurization and depressurization of, bladders 126, 128, 130, 132, 134 and 136. A more detailed presentation and discussion of the preferred method of the present invention is found hereafter, in accordance with treatment of a lower body extremity, more particularly the preparation and drainage of lymph fluid therefrom as depicted in FIGS. 8A–8E using, for example, the wrap of FIG. 7.

Each bladder of the illustrated embodiments has a generally arcuate configuration. The configuration and sequential pressurization/depressurization provides an orientation towards one or more node group(s). That is, radial lines extending from each bladder along its length extend generally toward one or more node groups. Configuration and direction provide an "orientation". Orientation is established by the direction of sequential pressurization/depressurization of the bladders and the configuration of the bladders on the body. The length of each bladder is optimally determined to move pooled fluids toward a node group. While it is expected that each bladder will be arcuate to some degree, the bladders need not be arcuate along their entire length nor need each bladder be arcuate so long as the bladders are "oriented" toward a node group, as described.

Referring generally to FIGS. 7 and 8A–8E, there is shown a wrap 12 adapted to fit about a body extremity, more particularly a lower body extremity. The wrap 12 generally has several regions (e.g., R1–R4), each of which having a plurality of compartments L5 (e.g., $C_1$ through $C_n$) distributed there through, with each of the compartments of the plurality of compartments capable of selective pressurization and depressurization so as to manipulate the wrapped body extremity in furtherance of lymphedema treatment.

Figure 7:
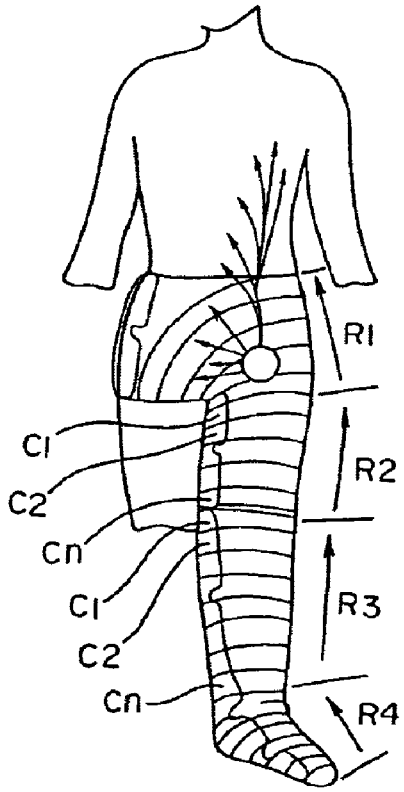
FIG. 7 shows a preferred wrap, about a lower body extremity, for practicing the method of the subject invention, with structures thereof delimited for the sake of discussion.

Referring now to FIG. 7, the several regions of the wrap 12 preferably include a trunk region (e.g., R1), and several limb regions (e.g., R2–R4). The trunk region of the wrap is preferably intended to correspond with (i.e., overlay) the hip or pelvic area of the torso, or more generally, at least a lower portion thereof, wherein the body extremity subject to treatment is a lower body extremity as show in FIGS. 8A–8E. Alternately, the trunk region of the wrap may correspond with (i.e., overlay) the shoulder and/or portions of the chest, or more generally, at least a upper portion thereof, wherein the body extremity subject to treatment is an upper body extremity as shown in FIGS. 5 and 6.

Figure 6A:
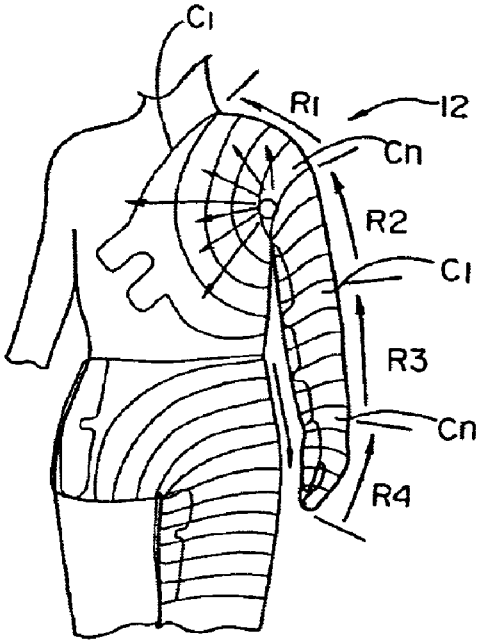
FIG. 6A shows a preferred wrap, about a upper body extremity, for practicing the method of the subject invention.

The limb regions of the wrap preferably are intended to correspond with (i.e., overlay) the thigh, calf, including the ankle, and foot. Alternately, the limb regions of the wrap may correspond with (i.e., overlay) the biceps, forearm, including the wrist, and hand, wherein the body extremity subject to treatment is an upper body extremity as shown in FIG. 6A.

A wrap suitable for implementing the preferred method of body manipulation may be consistent with that disclosed herein above, namely a wrap having a number of compartments which are sized to receive and hold a number of bladders which are in fluid communication with a pneumatic pump (see FIGS. 1, 3 and 4), however, the wrap is not necessarily so limited. For practice of the method of the subject invention, it is preferred that the wrap have several regions (e.g., R1 through R4), and discrete compartments (e.g., $C_1$ through $C_n$) distributed throughout each of the several regions R1 through R4. For the sake of convention, R1 is designated a "proximal" region, whereas R4 is designated a "distal" region; similarly, in any given region R1 through R4, $C_1$ is designated a "proximal" compartment, whereas $C_n$ is designated a "distal" compartment. Each of the compartments, $C_1$ through $C_n$, is capable of selective pressurization and depressurization, as by the pneumatic system described with respect to FIG. 1, or other mechanism for producing such effect, as is know to those of skill in the art. To insure proper therapeutic treatment, the width of the chambers is preferably, but not necessarily, on the order of about 1–2 inches. If the chambers are too wide (i.e., much larger than 3–4 inches), the effectiveness of the therapy received will be degraded. Based upon this preferred criteria, the number of compartments in a given region of the wrap (i.e., "n") will be variable, based on the extent (i.e., length dimension) of a given region "R."

As previous noted, MLD is highly desirable for the therapeutic results obtainable. MLD massage therapists are taught to treat five upper body sections (i.e., trunk, shoulder, biceps, forearm, and hand), and four sections of the lower body (i.e., trunk, thigh, calf, and foot). The MLD treatment technique applies just enough pressure to massage pooled fluids from larger areas toward specific lymph nodes within the body by mechanically stimulating the lymphatic system to cause contraction of the lymph collectors sufficient to help move the pooled fluids by promoting reabsorption of the polled fluids within the surrounding tissue. More particularly, the MLD treatment technique is performed in a proximal to distal pattern with respect to the body trunk (e.g., in the four lower body sections as follows: trunk, thigh, calf, and foot), with the hand being applied to the body so as to gently direct the fluid in the proximal direction (i.e., toward the body trunk).

The body extremity, once fitted with the wrap, undergoes a preparation step which includes a first pressurization and depressurization sequence of select compartments within select regions of the regions of the wrap. The preparation sequence generally starts in the trunk region and proceeds to a distal limb region of the several limb regions. More particularly, the sequence includes the consecutive pressurization and depressurization of each compartment of the compartments distributed throughout the selected region of the regions of the wrap, begining with a distal chamber and proceeding to a proximal chamber thereof.

Figure 8A:
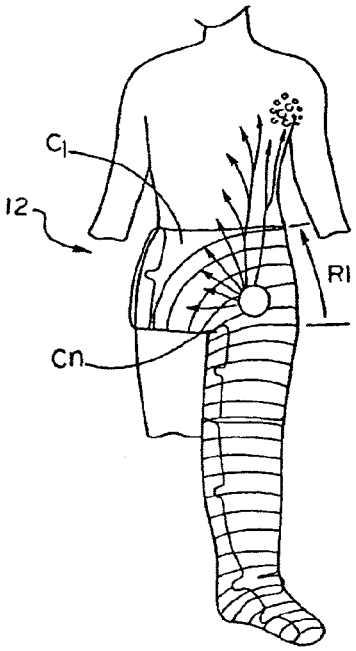
FIGS. 8A–8E depict the general steps associated with the preparation of a lower body extremity and drainage of lymph fluid therefrom via the method of the present invention.
Figure 8B:
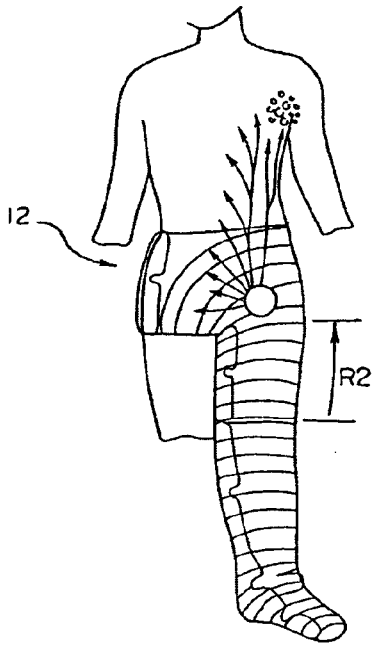
Figure 8C:
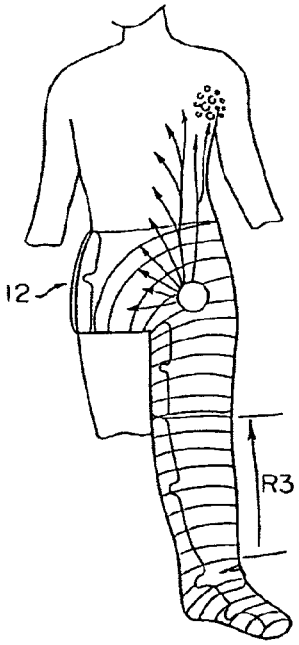
Figure 8D:
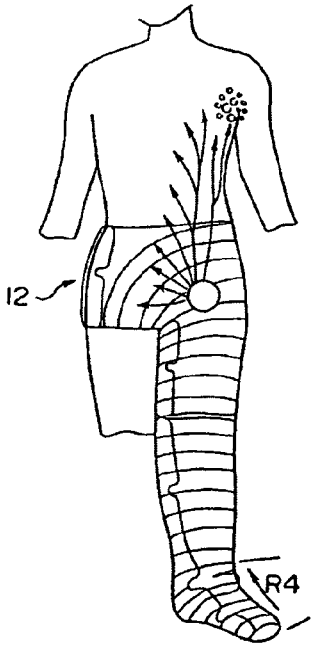
Figure 8E:
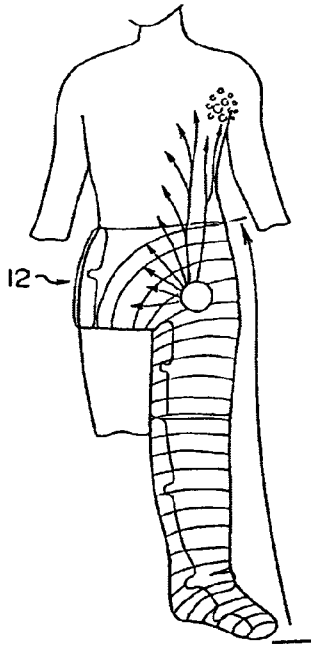

Referring now to FIGS. 8A–8E, the preferred method of the present invention, shown with respect to a lower body extremity, includes preparation (i.e., FIGS. 8A–8D) and drainage (FIG. 8E) steps. The compartments $C_n$ through $C_1$ of the trunk region R1 are selectively pressurized and depressurized in a direction toward the body trunk (i.e., a direction distal to proximal as shown by the arrow, or said more simply, from $C_n$ toward $C_1$), FIG. 8A. The adjacent region, namely the first of the several limb regions (i.e., R2), is likewise selectively pressurized and depressurized in a direction toward the trunk region (i.e., a direction distal to proximal as shown by the arrow, or said more simply, from $C_n$ toward $C_1$), FIG. 8B. The remaining limb regions, namely the second and third limb regions (i.e., regions R3 and R4 respectively), are selectively pressurized and depressurized in a direction toward the trunk region (i.e., a direction distal to proximal as shown by the arrow, or said more simply, from $C_n$ toward $C_1$), as shown in FIGS. 8C and 8D. In summary, the preferred preparation sequence or first pressurization/depressurization sequence proceeds as follows, R1, $C_n \rightarrow C_1$; R2, $C_n \rightarrow C_1$; R3, $C_n \rightarrow C_1$; and R4, $C_n \rightarrow C_1$., with the path from $C_n$ to $C_1$ being preferably consecutive, but not so limiting. For instance, patient symptoms may dictate that the selective pressurization and depressurization of the compartments of the regions not be uniform, either as to sequence (i.e., pressurization and/or depressurization order), quantum or duration of pressurization, from region to region, or within any given region.

After the preparation of the body extremity for receipt of lymph fluid, the body extremity undergoes a drainage step which includes a second pressurization and depressurization sequence of select compartments within select regions of the regions of the wrap such that the lymphatic system is stimulated so as to promote readsorption of pooled lymph fluid within surrounding tissue. The general sequence or order of pressurization and depressurization is from the distal region (i.e., R4) of the wrap regions sequentially or consecutively to adjacent regions (i.e., R3 to R2) until reaching the proximal region (i.e., R1). The compartments of each of the regions are consecutively pressurized and depressurized in a direction from the distal chamber to the proximal chamber (i.e., from $C_n$ toward $C_1$). In summary, the preferred drainage sequence or second pressurization/depressurization sequence proceeds as follows, R4, $C_n \rightarrow C_1$; R3, $C_n \rightarrow C_1$; R2, $C_n \rightarrow C_1$; and R1, $C_n \rightarrow C_1$, with the path from $C_n$ to $C_1$ being preferably consecutive, but not so limiting. As in the case of preparation, patient symptoms may dictate that the selective pressurization and depressurization of the compartments of the regions not be uniform, either as to sequence (i.e., pressurization and/or depressurization order), quantum or duration of pressurization, from region to region, or within any given region. The sequences of the method are preferably selected, for instance as by programming of a pneumatic controller or the like, on a patient specific basis for optimal therapeutic effect.

While a preferred embodiment of the present invention has been described, it should be understood that various changes, adaptations and modifications may be made therein without departing from the spirit of the invention. Changes may be made in details, particularly in matters of shape, size, material, and arrangement of parts without exceeding the scope of the invention. Accordingly, the scope of the invention is as defined in the language of the appended claims.

What is claimed is:

1. A method of body manipulation in furtherance of treating lymphedema comprising the steps of:

a. providing a wrap adapted to fit about a body extremity, said wrap having a trunk region, and a limb region having a plurality of regions and a plurality of compartments distributed throughout said regions, each of the compartments of said plurality of compartments being capable of selective pressurization and depressurization;

b. applying said wrap to said body extremity;

c. preparing the body extremity for receipt of lymph fluid via a first pressurization and depressurization sequence of select compartments within select regions of said regions of said wrap, said first pressurization and depressurization sequence beginning with said trunk region and proceeding to a distal limb region of said limb regions, said first pressurization and depressurization sequence including a consecutive pressurization and depressurization of each compartment of the compartments distributed throughout a limb region of the regions of said wrap beginning with a distal chamber of each limb region and proceeding to a proximal chamber thereof; and d. draining lymph fluid from the body extremity via a second pressurization and depressurization sequence of select compartments within select regions of said regions of said wrap, said second pressurization and depressurization sequence beginning with said distal limb region of said limb regions and proceeding to said trunk region, whereby the lymphatic system is stimulated so as to promote reabsorption of pooled lymph fluid within surrounding tissue.

2. The method of claim 1 wherein said second pressurization and depressurization sequence includes a consecutive pressurization and depressurization of each compartment of the compartments distributed throughout said selected region of the regions of said wrap beginning with a distal chamber and proceeding to a proximal chamber thereof.

3. The method of claim 2 wherein said limb regions are selected from the group consisting of foot, calf and thigh.

4. The method of claim 2 wherein said limb regions are selected from the group consisting of biceps, forearm and hand.

* * * * *